US005680968A

United States Patent [19]

Moore

[11] Patent Number: 5,680,968

[45] Date of Patent: Oct. 28, 1997

[54] CONTAINER CLOSURE SYSTEM

[75] Inventor: David N. Moore, Plainfield, Ill.

[73] Assignee: Phoenix Closures, Inc., Naperville, Ill.

[21] Appl. No.: 799,802

[22] Filed: Feb. 13, 1997

Related U.S. Application Data

[63] Continuation of Ser. No. 434,374, May 3, 1995, abandoned.

[51] Int. Cl.[6] ..... B67D 3/00

[52] U.S. Cl. ..... 222/480; 222/545

[58] Field of Search ..... 222/480, 545, 222/562, 565; 215/232, 321, 327, 349–351; 220/254, 258, 359

[56] References Cited

U.S. PATENT DOCUMENTS

| | | | |
|---|---|---|---|
| D. 274,791 | 7/1984 | Freeman | D9/352 |
| 2,547,590 | 4/1951 | McGinnis | 222/512 |
| 2,576,416 | 11/1951 | Randlett | 222/499 |
| 3,125,260 | 3/1964 | Dreps | 222/548 |
| 3,131,824 | 5/1964 | Baarn | 215/41 |
| 3,209,964 | 10/1965 | Knight | 222/545 |
| 3,260,426 | 7/1966 | Ayotte | 222/545 |
| 3,276,642 | 10/1966 | Johnson, Jr. et al. | 222/545 |
| 3,325,066 | 6/1967 | Allen | 222/545 |
| 3,469,748 | 9/1969 | Meyers | 222/563 |
| 3,612,325 | 10/1971 | Williams | 215/350 |
| 3,715,063 | 2/1973 | Susuki et al. | 222/545 |
| 3,980,211 | 9/1976 | Owens | 222/478 |
| 4,076,152 | 2/1978 | Mumford | 222/545 |
| 4,187,964 | 2/1980 | Bogart | 222/546 |
| 4,381,840 | 5/1983 | Ostrowsky | 215/350 |
| 4,437,593 | 3/1984 | Bullock, III | 222/541 |
| 4,463,869 | 8/1984 | Lewis | 220/307 |
| 4,600,131 | 7/1986 | Roof et al. | 222/478 |
| 4,981,229 | 1/1991 | Lanham | 215/232 |
| 5,065,908 | 11/1991 | Mengeu | 222/480 |
| 5,111,978 | 5/1992 | Mengeu | 222/545 |
| 5,183,171 | 2/1993 | Pherigo | 220/256 |
| 5,184,746 | 2/1993 | Moore et al. | 220/256 |
| 5,269,432 | 12/1993 | Beckertgis | 220/253 |
| 5,388,731 | 2/1995 | Mengeu et al. | 222/545 |
| 5,467,879 | 11/1995 | Moore | 222/565 |
| 5,513,781 | 5/1996 | Ullrich et al. | 222/565 |

*Primary Examiner*—Philippe Derakshani
*Attorney, Agent, or Firm*—Welsh & Katz, Ltd.

[57] ABSTRACT

A container closure system having a closure cap with a cover and a depending skirt with container engaging threads and a projecting post at the center of the underside of the closure cover. The system also includes a perforated fitment having a disk-like membrane with a plurality of apertures distributed across the membrane and an aperture of the plurality of apertures located at the center of the membrane for receiving the post. The fitment further includes a lip at the outer edge of the membrane for frictionally engaging a container at its rim when the system is applied to the container.

12 Claims, 1 Drawing Sheet

CONTAINER CLOSURE SYSTEM

This is a continuation of 08/434,374, filed May 3, 1995, now abandoned.

FIELD OF THE INVENTION

The invention relates to screw closures for food containers and more particularly to closures that provide flow control in the dispensing of dry, flowable, food product from the container.

BACKGROUND OF THE INVENTION

Food containers that provide flow control in the dispensing of product from such containers are known. Salt and pepper shakers are an example of one type of such container. Other examples include dispensers of red pepper or parmesan cheese. Spices or seasonings, in general, are typically dispensed from containers containing some type of flow-control device.

The container used in such applications is typically a small cylindrical container with an aperture at one end and containing a few ounces of material. The flow-control device covering the aperture is usually a cap with a number of holes penetrating the cap.

While such dispensing containers are useful, the life of the product within the container is often limited. Often the food product will become stale before it is used up. In addition, insects sometimes enter and infest the product, rendering the product unfit for human consumption.

To solve the problem of freshness and to protect the food product from insects it is often desirable to use an air-tight cap of some sort in conjunction with the flow-control device. While such an approach may be effective, many consumers would find it inconvenient to remove a freshness cap for installation of a flow-control cap (or visa versa) during normal use.

A more practical approach in such cases is often to design a flow control cap which fits underneath and works in conjunction with a freshness cap. While such an approach may be desirable, separate caps typically require separate provisions for attachment to the container. Additional attachment provisions, on the other hand, usually result in additional manufacturing steps and increased consumer costs.

One solution to the problem of flow-control and preservation of freshness of a liquid food product is provided by U.S. Pat. No. 4,187,964 to Bogart (Bogart). Bogart provides a spout on the top of the food container for flow control of the liquid food product and a re-closable cap which fits over the spout and seals the food container.

The structure surrounding the Bogart spout is provided with interlocking tabs which engaged the threads of the cap during manufacture and allowed the cap and spout to be attached to the food container as a single unit. The re-closable Bogart cap is also provided with a plug for engaging and sealing the spout to ensure freshness of the food product.

While Bogart provides a solution to flow control and freshness in liquid food products, some dry food products are not amenable to the Bogart solution. Red pepper, for instance, must be provided with a number of holes to ensure flow of the food product from the food container. Further, while a tight fitting cap may ensure freshness, a cap without a tamperproof seal does not protect the consumer.

Accordingly, it is a primary object of this invention to provide a container closure system that includes a freshness cap and flow control for dry food products that is also adapted for use with a tamperproof seal for protection of the consumer.

It is a further object of this invention to provide such functionality in a format that is adapted for the least number of assembly steps during manufacture.

SUMMARY OF THE INVENTION

The present invention provides a novel food container closure system including a freshness seal and product flow control that substantially overcomes the above problems. The container closure system has a closure cap with a cover and a depending skirt with container engaging means and a projecting post at the center of the underside of said closure cover. The system also includes a perforated fitment having a disk-like membrane with a plurality of apertures distributed across the membrane and an aperture of the plurality of apertures located at the center of said membrane for receiving said post. The fitment further includes means at the outer edge of said membrane for frictionally engaging a container at its rim when the system is applied to the container.

The solution to the problem of flow control and product protection lies, conceptually, in providing a perforated fitment adapted to an aperture of the food container and adapted to fit over and envelope a tamper-proof freshness seal. A cap is adapted to fit over both fitment and seal and provides a secondary freshness seal. A post projecting from an underside of the cap engages an aperture in the fitment thereby securing the fitment to the cap during assembly. Likewise, the fitment provides temporary support for the seal until such time as the seal is seated in place over the container aperture by screwing the cap onto the container.

BRIEF DESCRIPTION OF THE DRAWINGS

The features of the present invention which are believed to be novel are set forth with particularity in the appended claims. The invention, together with further objects and advantages thereof, may be best understood by reference to the following description in conjunction with the accompanying drawings.

DESCRIPTION OF A PREFERRED EMBODIMENT

Figure 1:
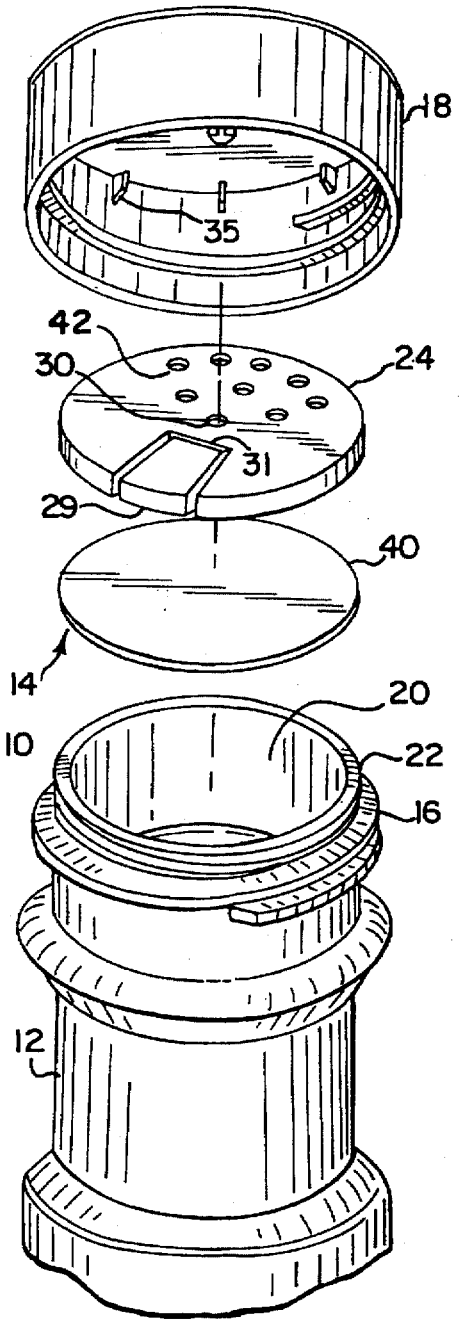
FIG. 1 is an exploded perspective view of a container and cap assembly in accordance with an embodiment of the invention.

FIG. 1 is an exploded perspective view of the container and closure system 10, generally, in accordance with the invention. Included within the system 10 is a container 12 and closure system 14. The closure system 14 is shown in more detail in the sectional view of FIG. 2.

The container 12 may be any suitable vessel adapted to containing the product. The container 12 may be fabricated of glass, plastic, polyester, or any other suitable material appropriate for the protection of the product held within.

The container 12 has a generally projecting aperture 20 through which the container 12 may be filled during manufacture and through which the product is dispensed during use. Surrounding the aperture 20 is a male thread 16 adapted to engage and secure the cap 18 of the closure system 14 to the container 12. Interposed between the thread 16 and aperture 20 is a lip 22 (shown in greater detail in FIG. 3). The lip 22 serves to frictionally engage and secure a perforated fitment 24 to the container 12.

The fitment 24 is a molded plastic article (e.g., polyethylene) of a generally disk-like shape which when secured to the container 12 forms a membrane covering the container aperture 20. A plurality of holes 42 in the membrane provide flow control in dispensing product (e.g., sprinkling spice or other seasonings over prepared foods).

An outer edge of the fitment 24 has a downwardly depending skirt or flange 26 with a groove 28 around its inner surface. The flange 26 and groove 28 are adapted to frictionally engage and secure the fitment 24 to the lip 22 of the container.

A closable spout 29 is also provided on the fitment 24 along an outer periphery of the fitment 24. To provide the closable spout 29, the location of the spout is scored along three sides. Along a back side the fitment 24 is scored only partially through the membrane to form a hinge 31. Along the radially projecting sides and along the downwardly projecting skirt 26 the score intermittently penetrates completely through the fitment 24. The groove 28 along a front part of the closable spout 29 and lip 22 of the container provide a catch which allows the spout 29 to be secured in a closed position.

The closure system 10 may be equipped with a tamperproof seal 40 or the closure system 10 may be equipped with a tamper-evident cap. Where a tamper-evident cap is used the cap 18 and fitment 24 are constructed to form an air-tight seal with the bottle 12 upon assembly.

Where a seal 40 is used, the seal 40 is designed to be interposed between the fitment 24 and the aperture 20 of the container 12. The seal 40 may be any tamperproof (or freshness sealing) material (e.g., adhesive coated material) adapted to form an air-tight seal with the container 12 when pressed against the upper surface of the container over the aperture 20 during assembly of the container system 10. The seal 40 has a circular shape with a diameter greater than an inside diameter of the flange 26 but less than that of the groove 28. The seal 40 engages and is secured within the groove 28 of the fitment 24 prior to assembly by pressing the seal 40 into such position.

The cap 18 comprises a top 32 and downwardly depending skirt 34 with a female thread 36 on an inner surface. A downwardly projecting, centrally located post 38 is also disposed on the underside of the cap 18. The downwardly projecting post 38 is adapted to frictionally engage a centrally located aperture 30 on the fitment 24 and secure the fitment 24 to the cap 18 during assembly.

Figure 2:
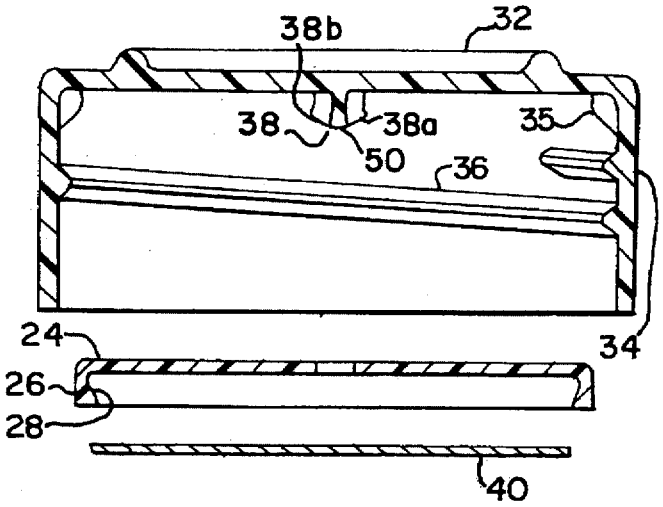
FIG. 2 is an exploded sectional view of the cap assembly of FIG. 1.
Figure 3:
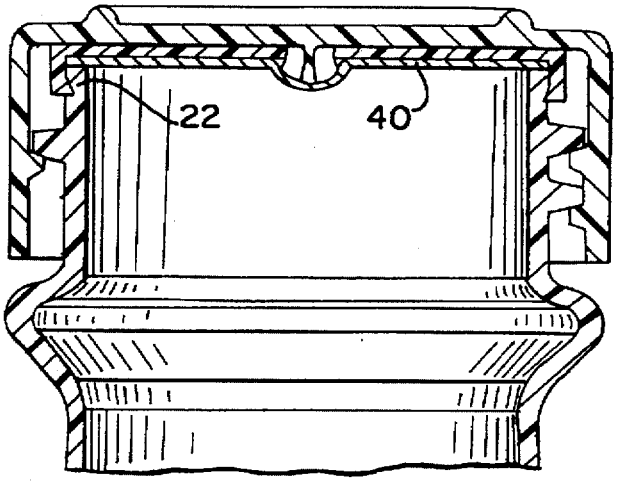
FIG. 3 is a sectional view of the container and cap assembly of FIG. 1.

As best seen in FIG. 2, the post 38 may have a cruciform cross-sectional shape, and can include a barbed portion 50 at the end thereof. The barbed portion 50 is defined by the angled sides 38*a,b* of the post 38. The barbed portion 50 is adapted to engage and lock into the center aperture 30 as illustrated in FIG. 3.

The cap 18 may also be equipped with a number of projections or abutments 35 on the under side of the cap 18 where the cover 32 meets the downwardly projecting skirt 34. The abutments 35 serve to align the centrally located aperture 30 of the fitment 24 to the post 38 of the cap 18 during assembly of the fitment 24 to the cap 18 and to hold the fitment 24 centrally to receive the bottle 12 during capping.

To facilitate assembly of the container system 10, the seal 40 is first pressed into the groove 28 of the fitment 24. The assembled seal 40 and fitment 24 are then pressed into the cap 18 to form a completed closure assembly 14. Since the seal 40 is constructed of a flexible material and the seal 40 is loosely held within the groove 28, it is understood that the post 38 does not perforate the seal 40 during assembly of the closure assembly 14 or after attachment of the closure assembly 14 to the container 12.

Also, since the seal 40 is captured within the fitment 24 and the fitment is secured to the cap 18 by the post 38, the closure assembly 14 comprises a one-piece unit that may be easily attached to the container during manufacture by automated means or otherwise. Following manufacture the force of the cap 18 against the fitment 24 and seal 40 may cause the seal 40 to form a bond with the container 12 that is not easily broken without damage to the seal 40. The seal 40 may also be heat-bonded to the bottle 12 by induction heating where the seal is constructed of an aluminum foil coated with a material selected to melt and bond with the top of the bottle 12. Such bond results in the formation of a tamperproof seal required for protection of consumers.

Following purchase of the product by a consumer, the cap 18 is unscrewed by the consumer. The fitment 24 is easily removed by fingernail or with the edge of a kitchen knife. The consumer then pierces the seal 40 for access to the product.

Following removal of the seal 40, the consumer may press the fitment 24 back into place over the lip 22 of the container 12 or may place the fitment 24 inside the cap 18 and screw the cap 18 back onto the container. Screwing the cap 18 onto the container 12 re-seats the fitment 24 over the lip 22 and onto the container 12.

With the seal 40 broken, the cap 18 and fitment 24 form a closure system 14 that not only protects the food product held by the container 12, but also provides the consumer with a means of dispensing the food product in a simple and convenient manner. With the cap 18 replaced, the cap 18 forms an impervious seal that preserves and protects the food product contained within.

Figure 4:
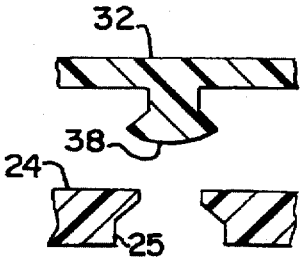
FIG. 4 is an partial exploded sectional view of the post and fitment of the cap assembly of FIG. 1 under an alternate embodiment.
Figure 5:
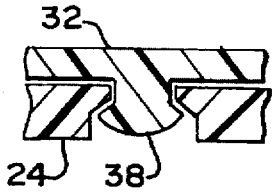
FIG. 5 is a sectional view of the alternate embodiment post and fitment of FIG. 4.

In an alternate embodiment (FIG. 4) the post 38 is given a flattened top and the fitment 24 is provided with a shallow recess 25. The recess 25 in the fitment 24 is constructed to receive the flattened post 38 (as shown in FIG. 5) without the post 38 extending past the fitment 24. The use of the flattened top of the post 38 and recess 25 prevents the possibility of the post 38 piercing the seal 40 during assembly. The flattened top of the post 38 also prevents any marking the aluminum seal 40, thereby avoiding the possibility of a consumer forming a perception of product tampering due to marking of the seal 40.

A specific embodiment of a container closure system according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

I claim:

1. A container closure system comprising:

a closure cap including a cover and a depending skirt with container engaging means;

a projecting post at the center of the underside of said closure cover said post having a cruciform cross-section and having a head portion at a distal end thereof in spaced relation to an underside of said closure cap, said head portion tapering inwardly, distally from said closure cap underside and terminating in a barbed portion;

a perforated fitment having a planar disk-like membrane with a plurality of apertures distributed across the membrane;

an aperture of the plurality of apertures located at the center of said membrane for receiving said post;

means at the outer edge of said membrane for frictionally engaging a container at its rim when the system is applied to the container; and a flexible freshness seal disposed within the means for frictionally engaging the container for engaging and sealing the container, wherein said barbed portion is configured to engage and removably lock into said center aperture of said membrane when said closure cap is engaged with an associated container.

2. The container closure system as in claim 1 further comprises a pour spout along a periphery of the membrane.

3. The container closure system as in claim 1 comprising means at the outer edge of the membrane for engaging the seal.

4. The container closure system as in claim 1 further comprising a plurality of radially aligned abutments on the underside of the cover at the junction of the cover and depending skirt.

5. A perforated top and closure cap for a spice container or the like, comprising:

the closure cap including a cover and a depending skirt with container engaging means;

a projecting post at the center of the underside of the closure cover said post having a cruciform cross-section and having a head portion at a distal end thereof in spaced relation to an underside of said closure cap, said head portion tapering inwardly, distally from said closure cap underside and terminating in a barbed portion;

the perforated top having a disk-like membrane with a plurality of apertures distributed about the membrane;

an aperture of the plurality of apertures located at the center of the membrane for receiving the post;

means at the outer edge of the membrane for frictionally engaging the container at its rim; and a flexible freshness seal disposed within the means for frictionally engaging the container for engaging and sealing the container, wherein said barbed portion is configured to engage and removably lock into said center aperture of said membrane when said closure cap is engaged with said spice container.

6. The perforated top and closure cap as in claim 5 further comprises a pour spout along a periphery of the membrane.

7. The perforated top and closure cap as in claim 5 comprising means at the outer edge of the membrane for engaging the seal.

8. The perforated top and closure cap as in claim 5 further comprising a plurality of radially aligned abutments on the underside of the cover at the junction of the cover and depending skirt.

9. A spice container or the like, comprising:

a container body having a projecting container aperture;

male threaded engagement means disposed on the projecting container aperture;

a lip interposed between the male threaded engagement means and container aperture;

a container closure cap including a cover and a dependent skirt;

female threaded engaging means disposed on the skirt for engaging the male threaded engagement means of the container aperture, a projecting post at the center of the underside of the closure cap said post having a cruciform cross-section and having a head portion at a distal end thereof in spaced relation to an underside of said closure cap, said head portion tapering inwardly, distally from said closure cap underside and terminating in a barbed portion;

a perforated top interposed between the container body and closure cap having a disk-like membrane with a plurality of holes disposed in the membrane;

a perforation of the plurality of perforations located at the center of the membrane for frictionally engaging the projecting post of the closure cap;

resilient engagement means at the outer edge of the membrane for frictionally engaging the lip of the container aperture; and a flexible freshness seal disposed within the means for frictionally engaging the container for engaging and sealing the container, wherein said barbed portion is configured to engage and removably lock into said center perforation of said membrane when said closure cap is engaged with said container body.

10. The container as in claim 9 further comprises a pour spout along a periphery of the membrane.

11. The container as in claim 9 comprising means at the outer edge of the membrane for engaging the seal.

12. The container as in claim 9 further comprising a plurality of radially aligned abutments on the underside of the cover at the junction of the cover and depending skirt.

* * * * *